US005555599A

United States Patent [19]

Markley

[11] Patent Number: 5,555,599

[45] Date of Patent: Sep. 17, 1996

[54] CARPET CLEANING BRUSH ASSEMBLY

[76] Inventor: Jim Markley, 360 N. Andreasen, Escondido, Calif. 92029

[21] Appl. No.: 574,343

[22] Filed: Dec. 18, 1995

[51] Int. Cl.[6] ..... A47L 9/06

[52] U.S. Cl. ..... 15/322; 15/361; 15/373; 15/410

[58] Field of Search ..... 15/321, 322, 361, 15/373, 410

[56] References Cited

U.S. PATENT DOCUMENTS

| | | | |
|---|---|---|---|
| 1,462,071 | 7/1923 | Rieman | 15/373 X |
| 2,214,862 | 9/1940 | Riebel | 15/410 X |
| 3,491,399 | 1/1970 | Dolan et al. | 15/373 X |
| 4,433,451 | 2/1984 | Parisi | 15/322 X |
| 5,113,547 | 5/1992 | Mayhew | 15/322 |

*Primary Examiner*—Chris K. Moore
*Attorney, Agent, or Firm*—John J. Murphey, Esq.; Murphey Law Offices

[57] ABSTRACT

A brush assembly for use with a carpet cleaner of the type comprising a cleaning liquid reservoir, cleaning liquid pump, distributing tubing, control valve, and spray nozzle, for applying a thin coating of cleaning liquid to the fibers of a carpet, and a suction nozzle mounted at the lower end of a stiff wand and including suction lines, a suction pump and a catch reservoir to collect the cleaning liquid and solubilized dirt as the nozzle is moved in a back and forth motion over the carpet, the assembly including a brush including a plurality of stiff bristles fixed at their upper end in a wide support and having free lower ends, a bracket for holding the brush in alignment at the suction nozzle, the bracket including device allowing the brush to move from a first upper position out of contact with the carpet to a second lower position wherein the free ends of the bristles come into contact with the carpet, an elongated cable of terminal length extending from a first terminal end connected to the brush upward along the wand to a second terminal end, a first handle attached to the second terminal end of the cable for maneuvering the brush, and a second handle fixed to the wand and positioned above it, intermediate the ends of the wand, and adjacent the first handle for grasping by the user, along with pulling on the first handle, to advance the brush into contact with the carpet, to allow the user to place additional downward pressure on the brush by leaning on the wand against the carpet during the back and forth cleaning motion.

13 Claims, 3 Drawing Sheets

CARPET CLEANING BRUSH ASSEMBLY

BACKGROUND OF THE INVENTION

1. Field of the Invention

This invention pertains to the field of cleaning equipment. More particularly, this invention pertains to carpet cleaning equipment and to a unique brush assembly that is useful in removing hard-to-remove deposits from carpets such as chewing gum and the like.

2. Description of the Prior Art

America is swiftly becoming an entertainment-oriented society. The few old-time restaurants and large, single movie houses have given way to numerous specialized and cultural-oriented restaurants and very large, multi-movie complexes that show a variety of different movies. In other aspects of our daily lives, there has been an explosion of banks, shops, craft stores, dentist's offices, doctor's offices and the like, such that Americans spend more and more time away from their homes.

Each of these businesses have one thing in common; they all are carpeted. Carpets are used to provide color and style to the interior decor, muffle the sound of walking, reduce the disturbing influence of talking among adults, giggling by children, and shouting by others, as well as to enhance the warmth of the interior and provide comfort to the feet. Carpeting usually consumes a substantial portion of the start-up capitalization of any business, and its useful life is often measured by how much the owner spends on keeping it clean and free from damaging trash.

With the change in life style from home-bound to office, shop and store-user, business owners have experienced a significant increase in the soiling of their carpeting. Because of the cost of new carpeting, keeping the existing carpeting clean and useful is both a duty and an advantage in lowering operating costs. In answer to the pressure of increased carpet cleaning, both carpet manufacturers have moved to stronger carpets, i.e., longer wearing fibers fixed in a tighter and longer lasting weave, while carpet cleaning equipment manufacturers have built and sold increasing amounts of equipment for the business owner to use in keeping his carpets clean.

Beyond the standard air vacuum cleaner, that is limited to cleaning carpets of dry debris, such as dust, lint, and the like, the only other carpet cleaning equipment of significant existence is the liquid-vacuum carpet cleaning machine. This machine operates on a principal of spraying a fine mist of low-foaming, soap-based cleaning liquid onto the surface of the carpet and following this almost immediately with a pass of a vacuum nozzle that sucks up the liquid along with water soluble dirt products. The vacuum thus cleans the carpet of both dry material and the surface of the fibers, where most of the contact occurs with those walking over it, is slightly washed to remove other dirt and stains. Annually or when needed, the carpets may be subjected to a deep steam cleaning to remove other products that are not picked up by dry vacuuming or the water-based washing. This deep cleaning, however, has its own disadvantages, such as changing the shape of the carpets, bleaching the color of the carpeting, loosening tacked-down carpets, and such and thus finds limited repeat application.

For reasons not fully understood, along with an increase in foot traffic on carpeting is an increase in the use of chewing gum. Whether this is just the normal outgrowth of better and more wide-spread chewing gum advertising, or is the result of a more nervous population, the fact remains that business owners are experiencing more and more deposits of chewing gum on their carpets. Chewing gum is probably the worst enemy of carpet. It is quickly walked down into the fibers; it attaches itself easily to shoe soles so that bits and pieces break off the original deposit (on the carpet) and are deposited in surrounding areas of the same or nearby carpet. Dirt and other debris stick to it. And, if not quickly removed, it is worked, by those walking on it, further and further down into the fibers of the carpet to a point deep enough to cause severe mechanical damage to the carpet backing. This results in such an unsightly mess that the carpet must be removed and replaced with new carpeting. All in all, chewing gum removal is the most expensive problem to carpet owners outside of total replacement.

I have provided the public with a solution to this problem in the form of my chewing gum-removing carpet cleaning device disclosed and claimed in U.S. Pat. No. 5,333,337. It is a special piece of equipment that can be used on deposits of chewing gum no matter if they are fresh or have existed for some time and removes them completely so that the carpet is like new again.

The prior art has attempted to combine a common brush with the liquid-vacuum carpet cleaning machine in an effort to have it deal with hard-to-remove stains and deposits. U.S. Pat. Nos. 2,199,643; 2,214.862; 4,014,068; 4,019,218; 4,156,952; 4,447,931; and, 4,638,526 all show carpet cleaning devices utilizing various types of brushes in an effort to force the cleaning liquid deeper into the fibers to remove deep stains and dirt. Unfortunately, these devices have not proven to be as efficacious as their designers had hoped. Primarily, it appears that the brushes are not located such that significant pressure can be applied to them to force the bristles down into the fibers in the brush. What results is merely a slight brush of the top of the fibers by the brush that provides only a slight improvement in the normal amount of cleaning of the carpet.

SUMMARY OF THE INVENTION

This invention is a brush assembly that can be either assembled with the liquid-vacuum carpet cleaning machine when it is first constructed or retrofitted to an existing machine as an after-market product. The brush is of a type and its assembly is of a type that allows significant pressure to be brought to bear on the carpet fibers, heretofore unavailable in the prior art. This invention is based upon the realization that for a brush to be successful in removing heavy deposits from a carpet, such as chewing gum and the like, the brush must be stiff and provided with an auxiliary handle that allows the user to lean his or her weight onto the brush to force it to penetrate into the deposit and break it up so that the liquid cleaner can further loosen it to allow the vacuum to remove it from the carpet.

The invention comprises a brush including a plurality of stiff bristles, mounted on a bracket at the front of the vacuum nozzle, and held there for movement between a first position out of contact with the carpet and a second position in contact with the carpet, where the handle that moves the brush into contact with the carpet is located adjacent a second handle mounted on the wand that allows the user to grasp both handles in one hand and lean on the stiff wand to force the brush bristles into the deposit. By this means the brush is used only when needed to remove a significant deposit, such as light deposits of chewing gum and the like, and then uses the user's body weight to effect the brushing and break down of the deposit. For heavier deposits, my patented device is still the best machine, however, this invention broadens the use of the common liquid-vacuum carpet cleaning machine to be useful to remove unwanted deposits that otherwise would not be removable without the inventive brush assembly.

Accordingly, the main object of this invention is a brush assembly for connection to the vacuum nozzle and stiff wand of a standard liquid-vacuum carpet cleaning machine for expanding the utilization thereof to remove light to medium deposits of debris such as sticky deposits from spilled drinks and chewing gum. Other objects of the invention include a brush assembly that can be assembled with the carpet cleaning machine as original equipment; a brush assembly that can be retrofitted to an existing carpet cleaning machine as an after-market device, a brush assembly that allows the user to apply his or her body weight to force the brush bristles into the deposit so as to remove the deposit without the need for arm pressure from the user that is not always available in young working people; a brush assembly that is useful in certain instances in the use of the liquid-vacuum carpet cleaning machine and placeable into a non-operational mode so that the machine can perform its normal duties without interference; a brush assembly that is operable by men and women alike and that may be used by those having minimum abilities without the need for extensive training; and, a brush assembly that, when used with the liquid-vacuum carpet cleaning machine, will extend the useful life of carpets thus lowering the requirement for carpet replacement and removing the burden for obtaining new materials from the environment.

These and other objects of the invention will become more apparent when reading the following Description of the Preferred Embodiment taken together with the drawings appended hereto. The scope of protection sought by the inventor may be gleaned from a fair reading of the Claims that conclude this Specification.

DESCRIPTION OF THE PREFERRED EMBODIMENT

Figures 1, 2:
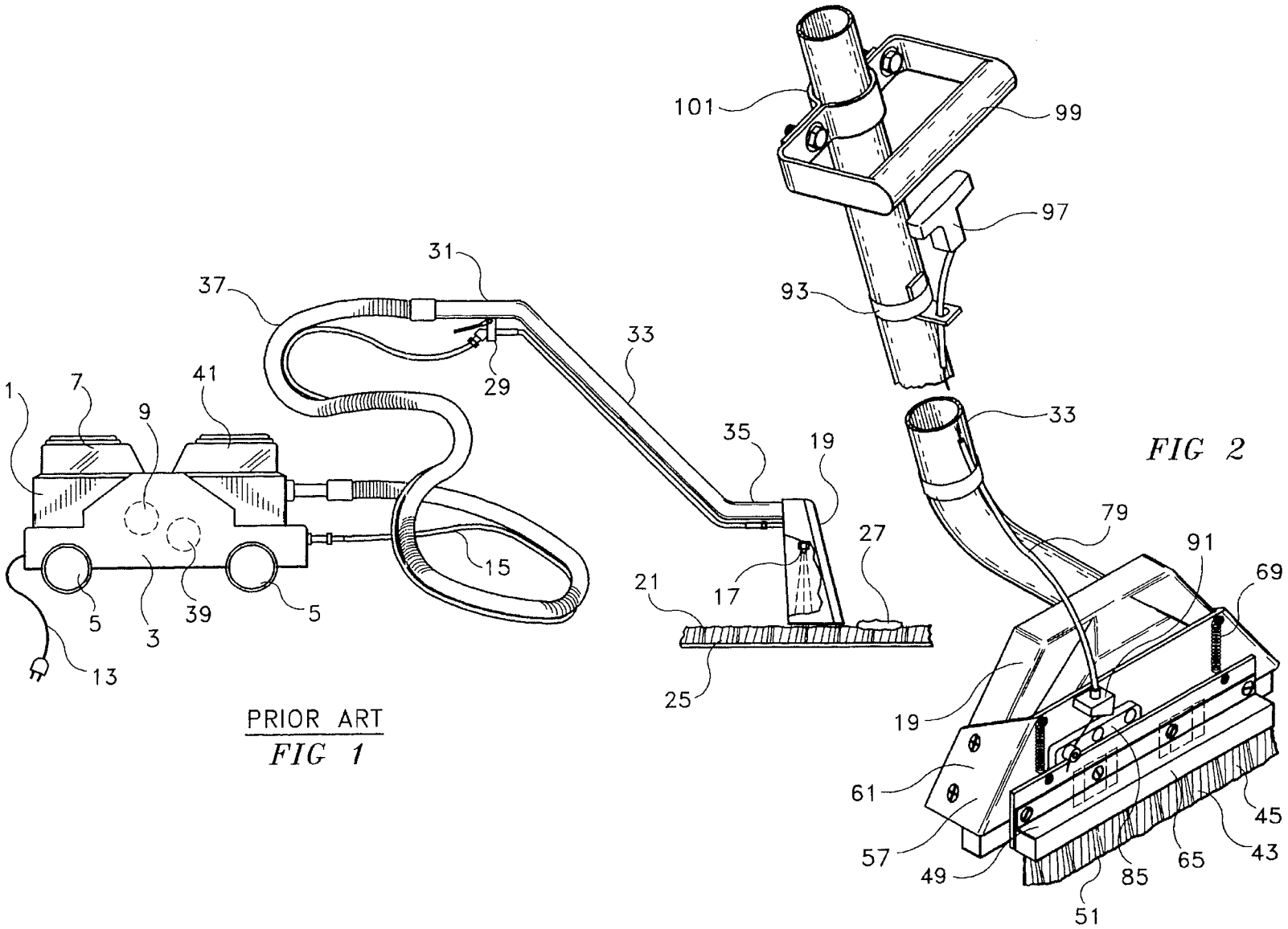
FIG 2 PRIOR ART
FIG. 1 is an illustrative view, partly in section, of a typical liquid-vacuum carpet cleaning machine of the prior art.
FIG. 2 is a an illustrative view of the preferred embodiment of this invention mounted on the wand of the standard liquid-vacuum carpet cleaning machine shown in FIG. 1.

Turning to the drawings, wherein like elements are identified by like numerals throughout the five figures, the standard liquid-vacuum cleaning machine 1 of the prior art is shown in FIG. 1 and comprises a body 3 moveable on wheels 5 and containing therein a cleaning liquid reservoir 7 for holding a charge of fresh carpet-cleaning liquid. A pump 9 is connected to said reservoir 7 (the piping is not shown in the machine for clarity) and is powered by electricity through power cord 13 to pump a volume of said liquid under pressure through a distribution line 15 to one or more spray nozzles 17 located behind a vacuum nozzle 19 where it is sprayed downward in a mist onto the top surface 21 of a carpet 25 that has a deposit 27 of chewing gum or other debris walked thereinto. Distribution line 15 passes through a control valve 29 that is manipulated by the user to control the amount of cleaning liquid that is sprayed on any portion of the carpet. The control valve is usually located at one end 31 (the top end) of an S-shaped rigid wand 33 that is connected at its other end 35 (the bottom end) to vacuum nozzle 19.

After the liquid is sprayed on carpet surface 21, vacuum nozzle 19 is drawn over the same area to suck up the liquid and solubilized dirt through a larger diameter vacuum line 37, powered by a suction pump 39, located in machine body 3 and also powered by electricity through power cord 13. The dirty liquid is deposited in a second reservoir 41 located in machine body 3 for eventual discarding.

Figure 3:
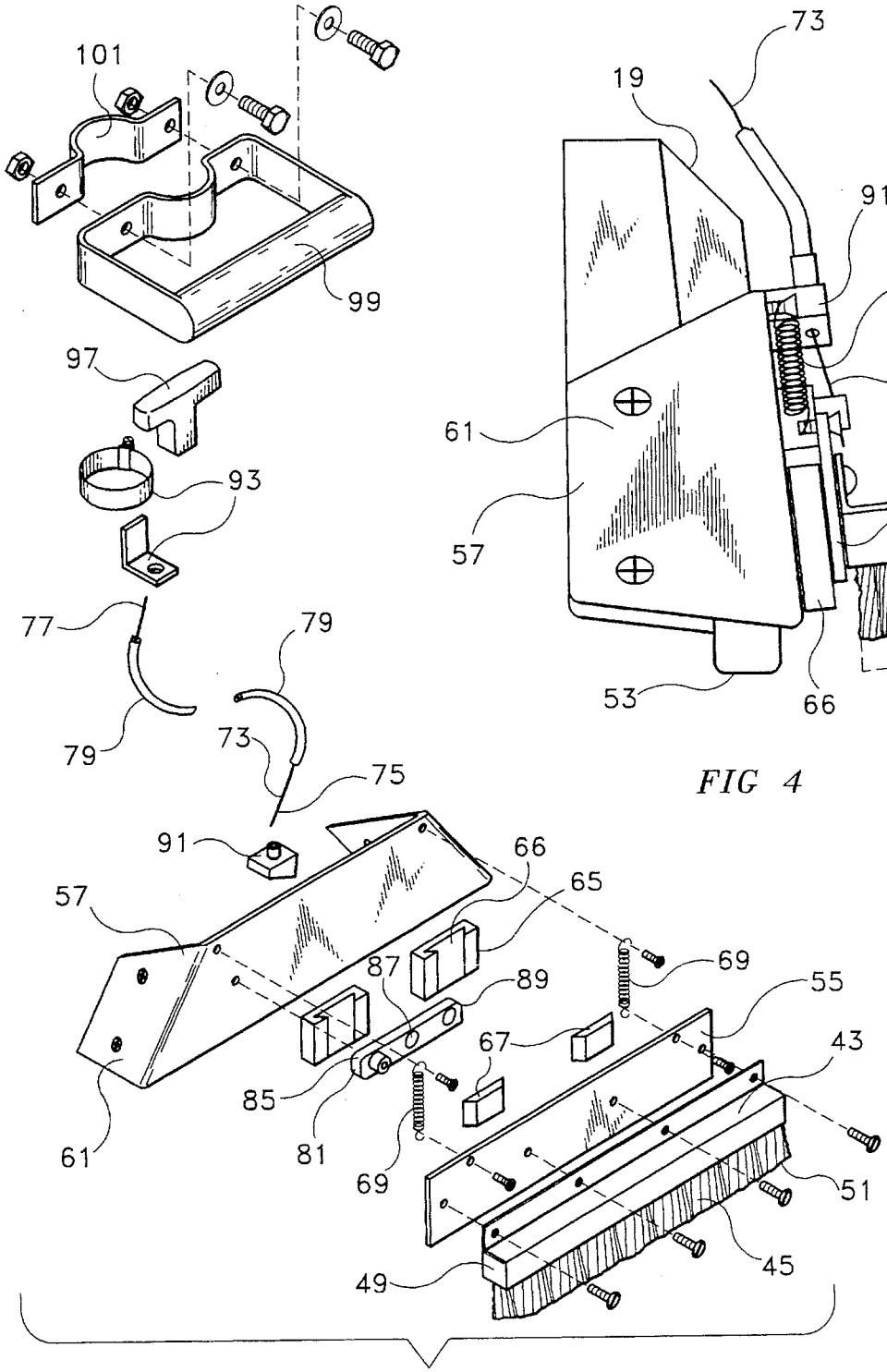
FIG. 3 is an exploded view of the parts making up this invention that can be packaged for retrofit, as an after-market product, on existing liquid-vacuum carpet cleaning machines.

This invention is shown in FIGS. 2 and 3 to comprise a brush 43 including a plurality of stiff brush bristles 45, such as nylon bristles, fixed at their upper ends very tightly in a wide support 49, preferably made of metal, such as aluminum, that spans most of the width of vacuum nozzle 19. The lower or free ends 51 of bristles 45 are preferably cut or formed in a straight line that is aligned parallel to the bottom edge 53 of vacuum nozzle 19. This allows the bristles to later contact the fibers in carpet surface 21 evenly to permit uniform cleaning to the affected area. It is preferred that support 49 not be as wide as vacuum nozzle 19 but slightly smaller to prevent creating messy conditions adjacent walls, coves or other such areas.

Brush 43 is mounted by screws on an alignment plate 55 that is preferably made of aluminum and is large enough to support said brush. A bracket 57 is attached by screws to the front surface of vacuum nozzle 19. For increased stability, a pair of wing 61 are bent back to form sides 63 conforming to the contour of nozzle 19 and are screwed or bolted thereto. A pair of tracks 65, in spaced-apart arrangement, are attached to the front of bracket 57 and placed in vertical alignment thereon. Tracks 65 contain an elongated internal, axially aligned cavity 66, such as a star-shaped cross-section, for matching receipt therein of a pair of runners 67, extending outward from the rear face of support 49, to allow reciprocal movement of brush 43 in an up and down motion on bracket 57.

Figure 4:
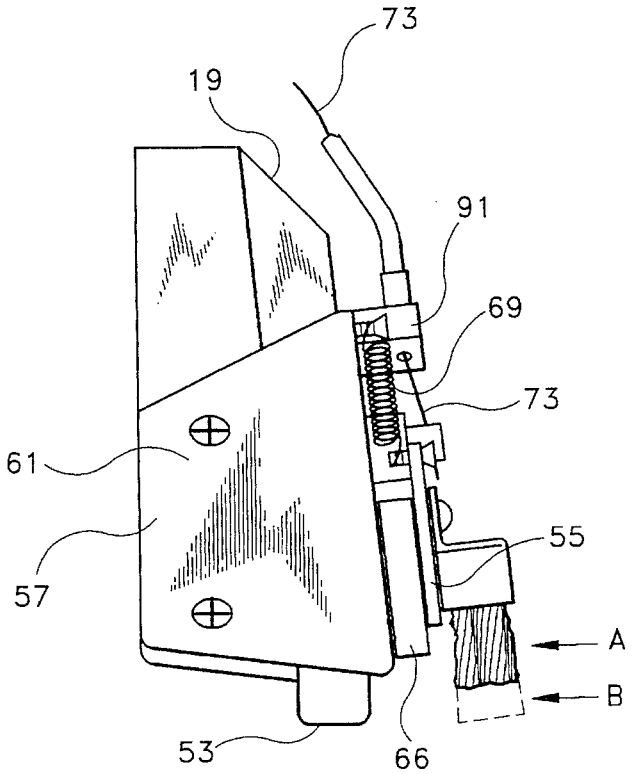
FIG. 4 is a side-elevational view of the vacuum head of a typical liquid-vacuum carpet cleaning machine showing the invention in place thereon and the two positions of the brush; and, FIG. 5 is an illustrative view of a person using the liquid-vacuum cleaning machine with the invention.
Figure 5:
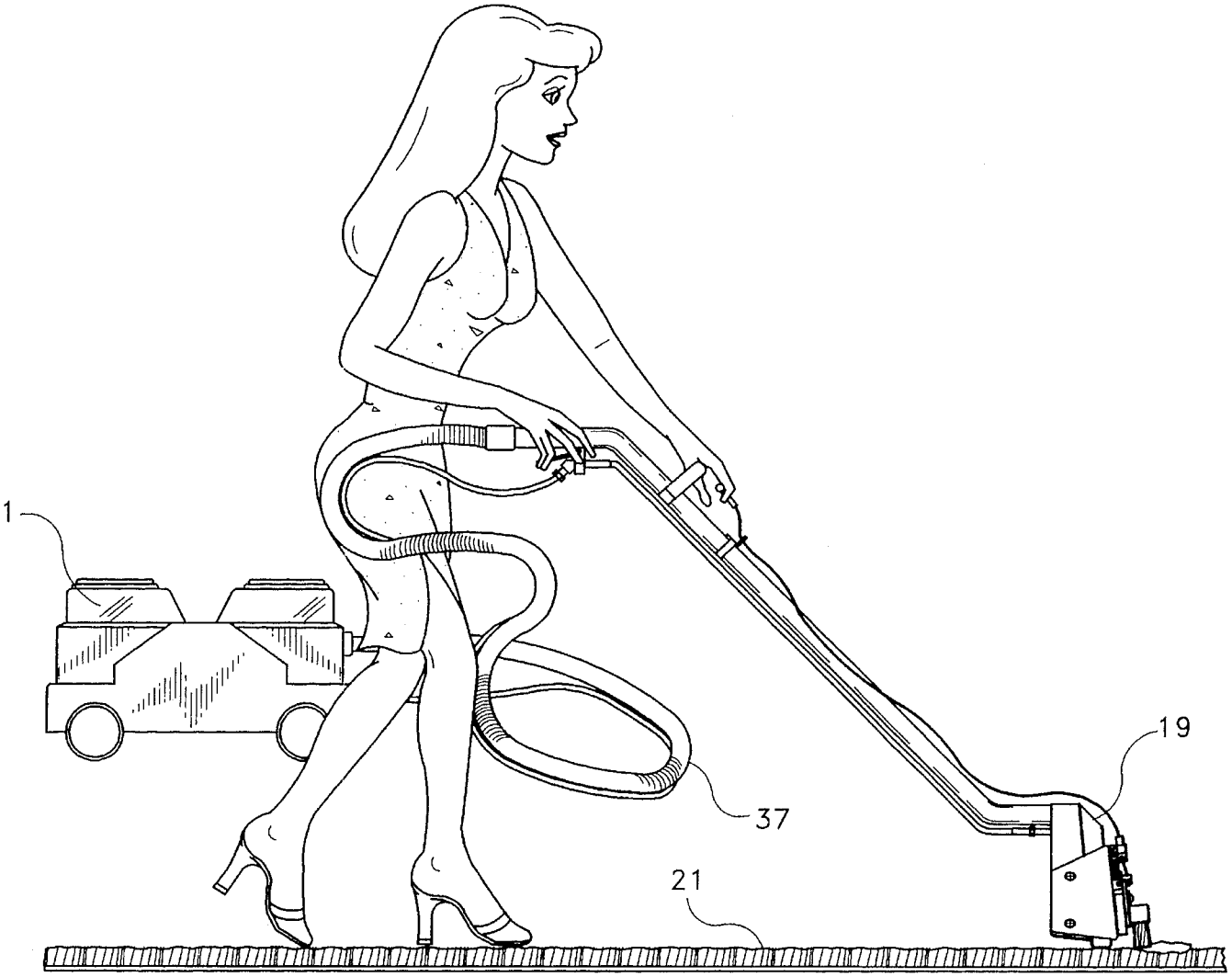

A pair of coiled springs 69 are attached at one end on bracket 57 above brush 43 and are attached at their other end to alignment plate 55 to bias it and brush 43 upward into a first position A, shown in FIG. 4, where the lower free ends 51 of bristles 45 are above carpet surface 21 and out of contact with said carpet. In this position, liquid-vacuum cleaning machine 1 is useable for its intended purpose.

An elongated cable 73, terminated by spaced-apart first and second distal ends 75 and 77, respectively, and preferably covered over by a sheath 79, is mounted at said first distal end 75 to one end 81 of an arm 85 that is pivotally mounted at its mid-point 87 on the front of bracket 57 above brush 43 and alignment plate 55. The other end 89 of arm 85 is in contact with alignment plate 55. Cable sheath 79 is mounted at one end at a fixture 91 on bracket 57 and at the other end by a bracket/clamp 93 on wand 33 preferably at about the midpoint of wand 33 as shown in FIG. 2.

Second distal cable end 77 is mounted to a first, T-shaped handle 97, adjacent the clamped end of cable sheath 79. A second, cross-bar type handle 99 is mounted by a clamp 101 on wand 33 just above and closely spaced to T-shaped handle 97. It is important that handle 99 be mounted above wand 33 as will be hereinafter more fully explained.

When a large deposit of debris 27, such as chewing gum, is encountered, when using the machine shown in FIG. 1, the user should spray at least two coats (or make two passes of the spray) of liquid thereon. Next the user should draw vacuum nozzle 19, by wand 33, across the deposit (preferably toward one's self) while at the same time grasping T-shaped handle 97 and pulling it, to move brush 43 from its normal position A to a downward position B into contact with deposit 27. While pulling handle 97, the user should grasp second handle 99 and lean his or her weight onto said handle and wand while holding handle 97 in the same hand. The two handles are small enough to be easily held in one hand.

The result of this action will be to strongly drive bristles 43 downward from position A to position B and into deep contact with deposit 27. This will cause a breakup of the deposit and allow vacuum nozzle 19 to suck up the broken pieces and transfer them into second reservoir 41 for later discard. The leaning action of the user is not dangerous because the leaning is done with the entire body so that no particular part is exposed or subject to isolated stress.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same results are within the scope of this invention.

What is claimed is:

1. A brush assembly for use with a carpet cleaner of the type comprising a cleaning liquid reservoir, cleaning liquid pump, distributing tubing, control valve, and spray nozzle, for applying a thin coating of cleaning liquid to the fibers of a carpet, and a suction nozzle mounted at the lower end of a stiff wand and including suction lines, a suction pump and a catch reservoir to collect the cleaning liquid and solubilized dirt as the nozzle is moved in a back and forth motion over the carpet, said assembly comprising:

a) a brush including a plurality of stiff bristles fixed at their upper end in a wide support and having free lower ends;

b) a bracket for holding said brush in alignment at the suction nozzle, said bracket including means allowing said brush to move from a first upper position out of contact with the carpet to a second lower position wherein said free ends of said bristles come into contact with the carpet;

c) an elongated cable of terminal length extending from a first terminal end connected to said brush upward along the wand to a second terminal end;

d) a first handle attached to said second terminal end of said cable for maneuvering said brush; and, e) a second handle fixed to the wand and positioned above it, intermediate the ends of the wand, and adjacent said first handle for grasping by the user, along with pulling on said first handle, to advance said brush into contact with the carpet, to allow the user to place additional downward pressure on said brush by leaning on the wand against the carpet during the back and forth cleaning motion.

2. The assembly of claim 1 further including a first clamp holding said first handle adjacent the wand.

3. The assembly of claim 1 further including a second clamp holding said second handle adjacent the wand.

4. The assembly of claim 1 further including a first clamp holding said first handle adjacent the wand and a second clamp holding said second handle adjacent said first handle.

5. The assembly of claim 1 wherein said bristles are set at a width less than the width of the suction nozzle.

6. The assembly of claim 1 further including a sheath covering said cable.

7. The assembly of claim 6 further including a clamp connecting said cable sheath to the wand.

8. The assembly of claim 1 wherein it is assembled with the carpet cleaner as original equipment.

9. The assembly of claim 1 wherein it is assembled in an after-market package for retrofit onto existing carpet cleaners.

10. The assembly of claim 1 where said bracket holds said brush in front of the suction nozzle.

11. The assembly of claim 1 wherein said free ends of said brush are fixed in a straight line for parallel contact with the carpet.

12. The assembly of claim 1 wherein said first handle is T-shaped and said second handle is a cross-bar type handle.

13. The assembly of claim 1 wherein said bristles are stiff nylon bristles.

* * * * *